US006895198B2

(12) United States Patent
Thompson et al.

(10) Patent No.: US 6,895,198 B2
(45) Date of Patent: May 17, 2005

(54) SEALING DEVICE USEFUL IN REMANUFACTURING A XEROGRAPHIC PHOTORECEPTOR MODULE

(75) Inventors: Allen J. Thompson, Sodus, NY (US); Willie J. Cottrell, Jr., Rochester, NY (US); Clifford W. Imes, IV, Rochester, NY (US); Charles H. Tabb, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/434,823

(22) Filed: May 9, 2003

(65) Prior Publication Data

US 2004/0223780 A1 Nov. 11, 2004

(51) Int. Cl.[7] ..... G03G 15/08; G03G 15/00
(52) U.S. Cl. ..... 399/102; 399/109
(58) Field of Search ..... 399/102, 107, 399/109, 110, 111, 123, 98

(56) References Cited

U.S. PATENT DOCUMENTS

| | | | | | |
|---|---|---|---|---|---|
| 4,400,082 | A | * | 8/1983 | Kiba | 399/102 |
| RE34,384 | E | * | 9/1993 | Ishiguro et al. | |
| 5,321,473 | A | | 6/1994 | Azami | |
| 5,389,732 | A | | 2/1995 | Sekino | 118/653 |
| 5,502,547 | A | * | 3/1996 | Shirai | 399/102 |
| 5,689,774 | A | * | 11/1997 | Shishido et al. | 399/111 |
| 5,697,021 | A | | 12/1997 | Watanabe et al. | 399/102 |
| 5,740,499 | A | * | 4/1998 | Higeta et al. | 399/105 |
| 5,966,566 | A | | 10/1999 | Odagawa et al. | 399/109 |
| 6,137,973 | A | * | 10/2000 | Nishiuwatoko et al. | 399/111 |
| 6,178,301 | B1 | * | 1/2001 | Kojima et al. | 399/98 |
| 6,658,223 | B2 | * | 12/2003 | Nishimura et al. | 399/102 |

* cited by examiner

*Primary Examiner*—Sandra L. Brase
(74) *Attorney, Agent, or Firm*—R. Hutter

(57) ABSTRACT

In a module for use in a xerographic printer, a substantially single-piece device includes thereon a cleaning blade, seal flap, and side seals for engaging a photoreceptor. The device can be easily replaced when the module is remanufactured.

26 Claims, 4 Drawing Sheets

SEALING DEVICE USEFUL IN REMANUFACTURING A XEROGRAPHIC PHOTORECEPTOR MODULE

TECHNICAL FIELD

The present disclosure relates to xerographic printing apparatus, and more specifically to a replaceable module, including a photoreceptor, for such an apparatus.

BACKGROUND

The basic principles of electrostatographic printing with dry marking material (hereinafter generally referred to as xerography) are well known: an electrostatic latent image is created on a charge-retentive surface, such as a photoreceptor or other charge receptor, and the latent image is developed by exposing it to a supply of toner particles, which are attracted as needed to appropriately-charged areas of the latent image. The toner particles are then transferred in imagewise fashion from the photoreceptor to a print sheet, the print sheet being subsequently heated to permanently fuse the toner particles thereto to form a durable image.

Following the transfer of the image from the photoreceptor to the print sheet, residual toner particles remaining on the photoreceptor are removed by any number of known means, such as including a cleaning blade, brush, and/or vacuum. In a typical embodiment, the removed toner is then accumulated in a hopper, and then the accumulated waste toner is directed, typically by means of an auger, into a waste container.

The present embodiment relates to aspects of a module which is readily removable and insertable in a xerographic printing apparatus, such as a "laser" printer or copier.

PRIOR ART

U.S. Pat. Nos. 5,321,473; 5,389,732; and 5,697,021 are examples of arrangements of side seals and cleaning blades associated with a photoreceptor in a removable cartridge used in xerographic printing.

SUMMARY OF THE INVENTION

According to one aspect of the present invention, there is provided a sealing device for use in a xerographic printing apparatus, the printing apparatus including a photoreceptor and a housing disposed around a portion of the photoreceptor. The sealing device comprises a cleaning blade disposed on a first member; a flap disposed on a second member; and a third member, connecting the first member to the second member. The sealing device is readily removable from the housing.

According to another aspect of the present invention, there is provided a module for use in a xerographic printing apparatus, the module including a photoreceptor and a housing disposed around a portion of the photoreceptor. The module further comprises a sealing device, the sealing device including a cleaning blade disposed on a first member, a flap disposed on a second member, and a third member connecting the first member to the second member. The sealing device is readily removable from the housing.

According to another aspect of the present invention, there is provided a method of remanufacturing a module for use in a xerographic printing apparatus, the module including a photoreceptor, a housing disposed around a portion of the photoreceptor, and a sealing device. The sealing device includes a cleaning blade disposed on a first member, a flap disposed on a second member, and a third member connecting the first member to the second member. The method comprises removing the sealing device from the module.

DETAILED DESCRIPTION

Figure 1:
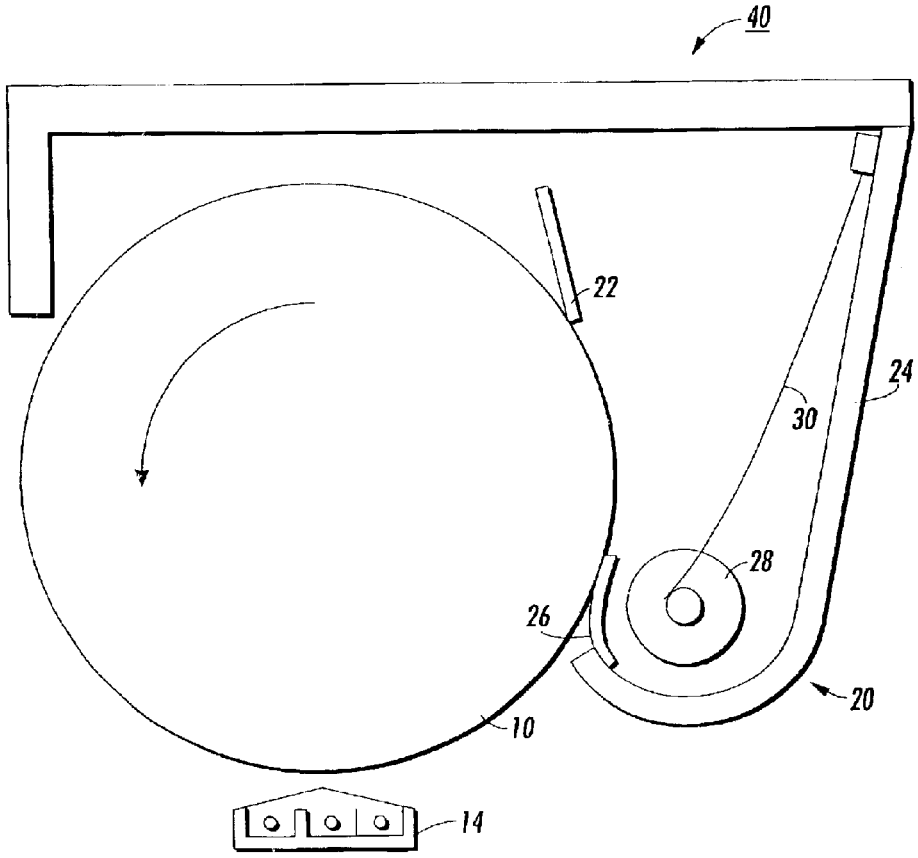
FIG. 1 PRIOR ART
FIG. 1 is a simplified elevational view showing elements of an electrostatographic or xerographic printing apparatus, many of which are disposed within a removable module.
Figure 2:
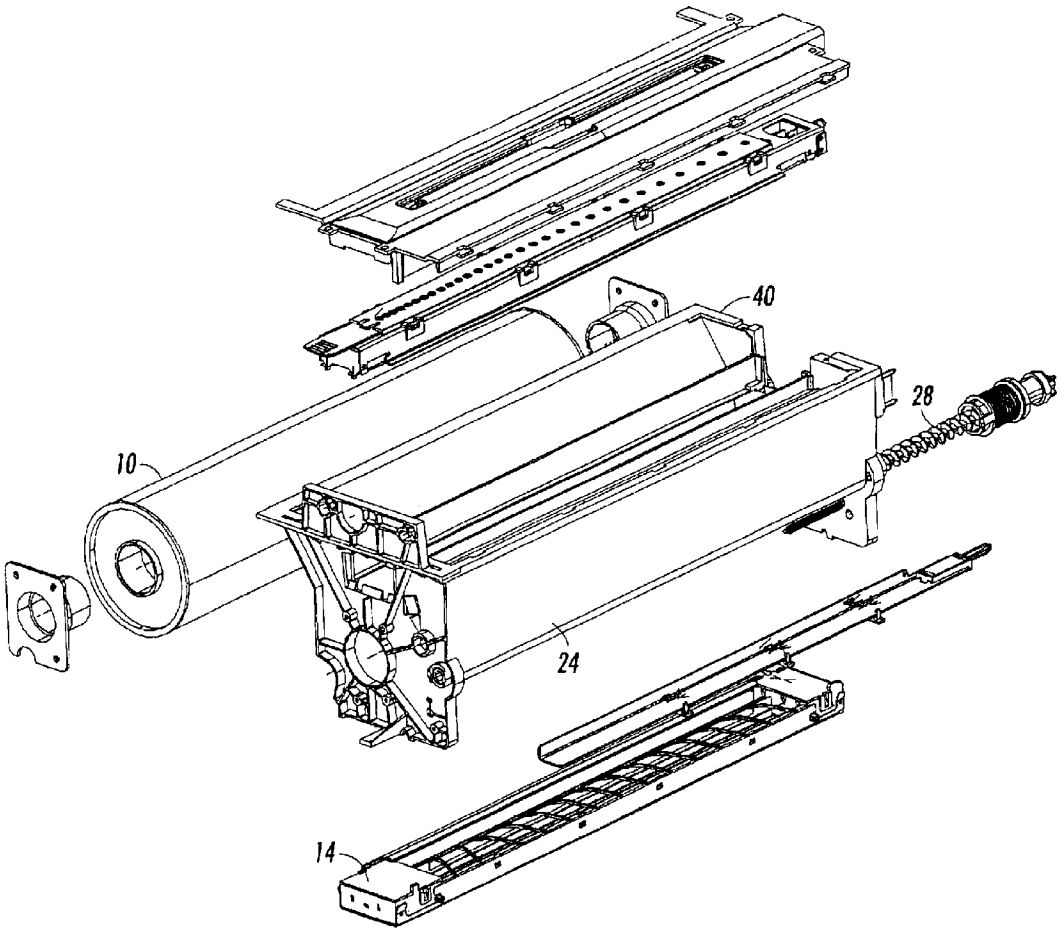
FIG. 2 PRIOR ART
FIG. 2 is a partially exploded view of a practical embodiment of a module.

FIG. 1 is a simplified elevational view, and FIG. 2 is a partially exploded perspective view, showing relevant elements of an electrostatographic or xerographic printing apparatus, many of which are disposed within a module housing generally shown as 40. As is well known, an electrostatic latent image is created, by means not shown, on a surface of a charge receptor or photoreceptor 10. The latent image is developed by applying thereto a supply of toner particles, such as with a developer roll (not shown), which may be of any of various designs such as a magnetic brush roll or donor roll, as is familiar in the art. The toner particles adhere to the appropriately-charged areas of the latent image. The surface of photoreceptor 10 then moves, as shown by the arrow, to a transfer zone created by a transfer-detack assembly generally indicated as 14. Simultaneously, a print sheet on which an desired image is to be printed is conveyed to the transfer zone as well.

At the transfer zone 14, the print sheet is brought into contact or at least proximity with a surface of photoreceptor 10, which at this point is carrying toner particles thereon. A corotron or other charge source at the transfer zone causes the toner on photoreceptor 10 to be electrically transferred to the print sheet. The print sheet is then sent to subsequent stations, as is familiar in the art, such as a fuser and finishing devices (not shown).

Following transfer of most of the toner particles to the print sheet in the transfer zone, any residual toner particles remaining on the surface of photoreceptor 10 are removed at a cleaning station, which is generally indicated as 20. A cleaning blade 22 which is urged against the surface of photoreceptor 10 scrapes the residual toner off the surface. The toner which is thus removed falls downward into a hopper 24 formed in housing 40 for accumulating the toner. A flexible flap seal 26, extending the length of the photoreceptor 10, prevents loose toner from escaping the hopper.

At the bottom of the hopper is an auger 28, shown end-on in the view of FIG. 1, and shown partially removed in the view of FIG. 2. The auger extends substantially the length of the photoreceptor 10. The auger 28 is rotated and thus conveys toner particles at the bottom of the hopper to some sort of waste container (not shown). An agitator 30, made of a thin, flexible material, can interact with the auger to clean the flights of the auger.

In a typical practical implementation, module 40 is readily removable, and thus replaceable, from a larger printing apparatus such as a digital copier. The spent module removed from a copier is sent to a vendor or "remanufacturer," who replaces or otherwise reconditions parts in the module, making the module again useable in a printing apparatus. Among the parts which often require replacement when remanufacturing a module such as 40 are, in addition to photoreceptor 10, cleaning blade 22 and flap seal 26. To set the cleaning blade 22 and flap seal 26 against the surfaces of photoreceptor 10 for proper operation of the module tends to require either close tolerances and/or precise dexterity in the remanufacturing operation.

Figure 3:
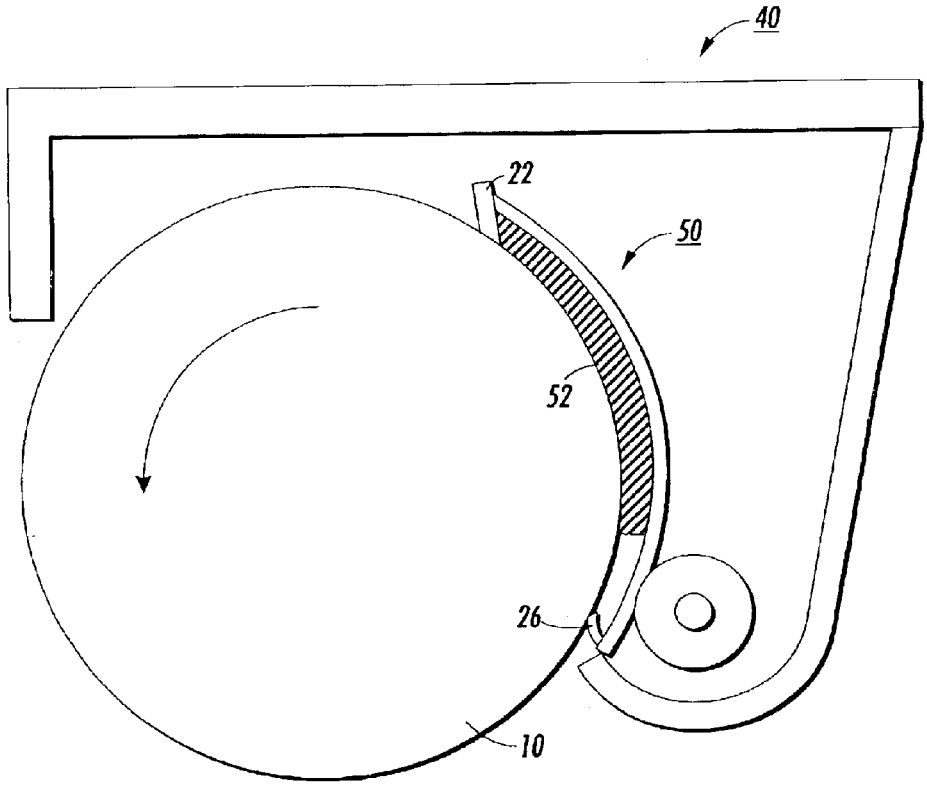
FIG. 3 is an elevational view of a sealing device as it is installed against a surface of photoreceptor in a module.
Figure 4:
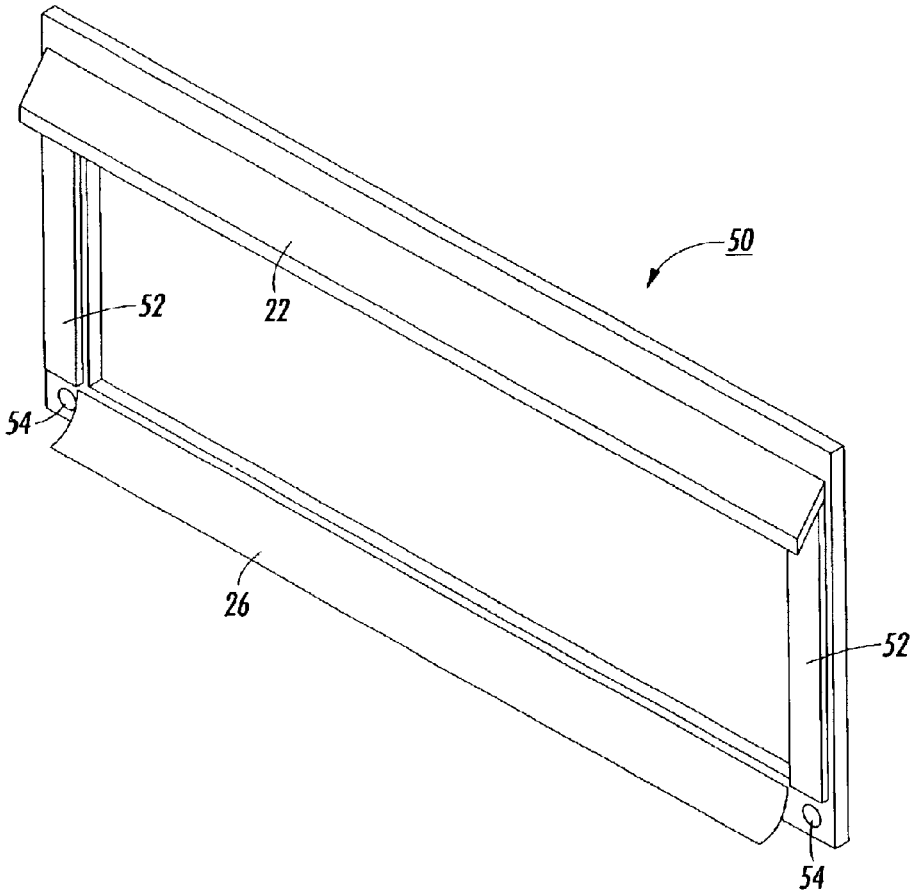
FIG. 4 is a view of a sealing device used in a module, in isolation.

FIGS. 3 and 4 show a sealing device 50, which is in effect of one piece, which can be readily installed and replaced within a larger apparatus such as module 40. FIG. 3 shows the device 50 as installed in module 40, while FIG. 4 shows the device 50 in isolation. Looking first at FIG. 4, the device 50 includes the cleaning blade 22 and flap seal 26, which form (or are mounted on) opposite sides of a generally rectangular frame. In a practical embodiment, cleaning blade 22 is formed of a semi-rigid polyurethane member which contacts a photoreceptor, while flap seal 26 includes a relatively thin polyethylene member. The other two opposite sides of the frame form (or have mounted thereon) seals 52, each of which engages, slidingly and sealingly, a portion of the surface of photoreceptor 10, in an non-imaged area at the end thereof. In a practical embodiment, each seal 52 substantially comprises a compressible foam plastic with a low-friction layer on the outer surface which engages photoreceptor 10.

The main body of device 50, on which the various parts are mounted, can be made of metal or plastic, but it is conceivable that any of the parts such as cleaning blade 22 and flap seal 26, or seals 52, or portions thereof, can be formed integrally (such as by molding) with the main body of the device 50.

As can be seen in FIG. 3, the seals 52 must conform to the curvature of the photoreceptor 10 when the device 50 is installed; this conforming can be accomplished either by making the sides of device 50 having the seals 52 substantially rigid but curved to conform to the photoreceptor 10; or, by having the sides of device 50 having the seals 52 be flexible, to conform to the desired shape when the device 50 is installed in module 40.

In the illustrated embodiment, cleaning blade 22 is suitably rigid so that only an edge thereof contacts the photoreceptor 10 when the device 50 is installed in module 40, and also is mounted against the direction of rotation of photoreceptor 10. Further, relatively flexible flap seal 26 is arranged so that, near device 50, the flap seal extends against the direction of rotation of photoreceptor 10, but, toward the end thereof, flexes to point with the direction of rotation of photoreceptor 10, as shown in FIG. 4.

The device 50, whatever its specific structure, facilitates relatively simple construction or remanufacturing of a module 40 or larger apparatus. The device 50 can be effectively mounted within a module 40 by straightforward means, such as screws, clips, adhesives, etc. As shown in FIG. 4, the device can thus include one or more screw-holes such as 54, or define one or more suitably-positioned surfaces to permit attachment to complementary surfaces in module 40 by means of an adhesive. The device 50 can be made readily removable and replaceable merely by dimensioning the device 50 so that placement within a tightly-defined space within the module 40 causes the device to be firmly acnchored in the module 40. As such, in a remanufacturing process, such as on a spent or returned module 40, a device 50 can be quickly removed from the spent module and replaced by a new device 50. By replacing the module 50, both the cleaning blade 22 and flap seal 26, as well as the side seals 52, are replaced in a single operation, which is likely to take much less time than replacing any single one of those parts within module 40.

What is claimed is:

1. A sealing device for use in a xerographic printing apparatus, the printing apparatus including a photoreceptor and a housing disposed around a portion of the photoreceptor, the housing suitable for retaining marking material, comprising:

a cleaning blade disposed on a first member;

a flap disposed on a second member; and a third member, connecting the first member to the second member;

the sealing device being readily removable in one piece from the housing.

2. The sealing device of claim 1, further cormprising a seal disposed on the third member, the seal suitable for conforming to a portion of a surface of the photoreceptor.

3. The sealing device of claim 1, further comprising a fourth member, the fourth member connecting the first member to the second member;

a seal disposed on the fourth member, the seal suitable for conforming to a portion of a surface of the photoreceptor.

4. The sealing device of claim 1, further comprising an opening in the sealing device for attaching the sealing device to the housing by a screw.

5. The sealing device of claim 1, further comprising a surface on the sealing device suitable for attaching the sealing device to the housing by an adhesive.

6. The sealing device of claim 1, wherein the sealing device is dimensioned to fit tightly in the housing.

7. The sealing device of claim 1, wherein the cleaning blade is more rigid than the flap.

8. The sealing device of claim 1, wherein the cleaning blade is oriented in a first direction, and the flap is oriented in the first direction near the device and is flexible near an end thereof to flex in a second direction opposite the first direction.

9. A module which is readily installable in a xerographic printing apparatus, comprising a photoreceptor;

a housing disposed around a portion of the photoreceptor, the housing suitable for retaining marking material; and a sealing device, the sealing device including a cleaning blade disposed on a first member, a flap disposed on a second member, and a third member connecting the first member to the second member;

the sealing device being readily removable in one piece from the housing.

10. The module of claim 9, the sealing device further including a seal disposed on the third member, the seal including a seal member suitable for conforming to a portion of a surface of the photoreceptor.

11. The module of claim 9, the sealing device further including a fourth member, the fourth member connecting the first member to the second member, and a seal disposed on the fourth member, suitable for conforming to a second portion of a surface of the photoreceptor.

12. The module of claim 9, the sealing device further including an opening for attaching the sealing device to the housing by a screw.

13. The module of claim 9, the sealing device further including a surface suitable for attaching the sealing device to the housing by an adhesive.

14. The module of claim 9, wherein the sealing device is dimensioned to fit tightly in the housing.

15. The module of claim 9, wherein the cleaning blade is more rigid than the flap.

16. The module of claim 9, wherein the cleaning blade is oriented against a direction of rotation of the photoreceptor.

17. The module of claim 9, wherein the flap is oriented against a direction of rotation of the photoreceptor the device and is flexible near an end thereof to flex with the direction of rotation of the photoreceptor.

18. A method of remanufacturing a module for use in a xerographic printing apparatus, the module including a photoreceptor, a housing disposed around a portion of the photoreceptor; the housing suitable for retaining marking material, and a sealing device disposed between the housing and the photoreceptor, the sealing device including a cleaning blade disposed on a first member, a flap disposed on a second member, and a third member connecting the first member to the second member;

the method comprising removing the sealing device in one piece from the module.

19. The method of claim 18, the removing step including loosening a screw attaching the sealing device from the module.

20. The method of claim 18, the removing step including loosening an adhesive attaching the sealing device from the module.

21. The method of claim 18, the sealing device further including a seal disposed on the third member, the seal including a seal member suitable for conforming to a portion of a surface of the photoreceptor.

22. The method of claim 18, wherein, in the sealing device, the cleaning blade is more rigid than the flap.

23. The method of claim 18, wherein, in the sealing device, the cleaning blade is oriented against a direction of rotation of the photoreceptor.

24. The method of claim 18, wherein, in the sealing device, the flap is oriented against a direction of rotation of the photoreceptor the device and is flexible near an end thereof to flex with the direction of rotation of the photoreceptor.

25. The method of claim 18, the sealing device further including a fourth member, the fourth member connecting the first member to the second member, and a seal disposed on the fourth member, the seal suitable for conforming to a second portion of a surface of the photoreceptor.

26. The method of claim 18, further comprising placing a new sealing device in the module.

* * * * *